US005694796A

United States Patent [19]

Couillard et al.

[11] Patent Number: 5,694,796

[45] Date of Patent: Dec. 9, 1997

[54] HINGED LOCK WITH DETENT POSITIONS

[76] Inventors: Richard Alexander Couillard; Joyce Lynne Hahn, both of 7217 Curtis Street, Burnaby, British Columbia, Canada, V5A 1K1; George Henry Preis, 809 Seymour Boulevard, North Vancouver, British Columbia, Canada, V7J 2S5

[21] Appl. No.: 413,995

[22] Filed: Mar. 30, 1995

[51] Int. Cl.[6] ..... F05B 67/22

[52] U.S. Cl. ..... 70/39; 70/46; 70/38 R

[58] Field of Search ..... 70/39, 38 R, 38 A, 70/43, 46, 28, 233

[56] References Cited

U.S. PATENT DOCUMENTS

| | | | |
|---|---|---|---|
| 187,362 | 2/1877 | Dilg . | |
| D. 238,548 | 1/1976 | Seakan | 8/114 |
| 263,212 | 8/1882 | Pettibone . | |
| 410,027 | 8/1889 | Rueckert . | |
| 491,102 | 2/1893 | Halleden . | |
| 584,575 | 6/1897 | Cornell . | |
| 1,036,992 | 8/1912 | Franki . | |
| 1,384,590 | 7/1921 | Bottone . | |
| 1,419,358 | 6/1922 | Christoph | 70/46 X |
| 1,424,543 | 8/1922 | Wiloch . | |
| 1,461,725 | 7/1923 | Cooper . | |
| 1,503,210 | 7/1924 | Shannon . | |
| 1,542,016 | 6/1925 | Stull . | |
| 1,618,924 | 2/1927 | Hanton . | |
| 1,629,859 | 5/1927 | Burke . | |
| 1,638,264 | 8/1927 | Junkunc . | |
| 1,661,777 | 3/1928 | Sczepczenski | 70/46 |
| 1,679,665 | 8/1928 | Junkunc . | |
| 1,690,938 | 11/1928 | Maxwell . | |
| 2,471,291 | 5/1949 | Soref et al. | 76/38 |
| 3,721,112 | 3/1973 | Wellekens | 70/39 |
| 3,739,607 | 6/1973 | Smedley | 70/18 |
| 3,754,418 | 8/1973 | Miller | 70/18 |
| 3,755,778 | 8/1973 | Kennedy et al. | 340/65 |
| 3,777,517 | 12/1973 | Shwayder et al. | 70/53 |
| 3,800,570 | 4/1974 | Kaplan | 70/18 |
| 3,855,826 | 12/1974 | Hori | 70/38 A |
| 3,924,426 | 12/1975 | Zane et al. | 70/18 |
| 3,967,475 | 7/1976 | Zane | 70/18 |
| 4,064,716 | 12/1977 | Shwayder et al. | 70/38 A |
| 4,085,600 | 4/1978 | Bindari | 70/39 |
| 4,155,231 | 5/1979 | Zane et al. | 70/18 |
| 4,256,322 | 3/1981 | Otsuka et al. | 280/289 L |
| 4,271,690 | 6/1981 | Jaulmes | 70/233 |
| 4,324,119 | 4/1982 | Mitton | 70/233 |

(List continued on next page.)

FOREIGN PATENT DOCUMENTS

| | | |
|---|---|---|
| 92289 | 11/1961 | Denmark . |
| 105187 | 7/1898 | Germany . |
| 111976 | 9/1898 | Germany . |
| 376842 | 6/1923 | Germany . |
| 388160 | 1/1924 | Germany . |
| 491840 | 2/1930 | Germany . |
| 824896 | 12/1951 | Germany . |
| 182417 | 10/1922 | United Kingdom . |
| 471118 | 8/1937 | United Kingdom . |

*Primary Examiner*—Rodney M. Lindsey
*Assistant Examiner*—Monica E. Millner
*Attorney, Agent, or Firm*—Bull, Housser & Tupper

[57] ABSTRACT

A lock apparatus including a shackle having first and second joined leg portions and a cross member pivotally connected to the first leg portion for pivotal rotation relative to the shackle, about a pivotal axis. The cross member has an opening for receiving a portion of the second leg portion therein when the lock is in a closed position and a bolt connected to the cross member is operable to selectively releasably engage the second leg portion when the lock is in the closed position. The apparatus further includes a lock position holder including a contact member on the cross member and a detent member on the shackle. The contact member and detent member are engageable with each other such that relative movement between the contact member and the detent member is resisted, to interfere with movement of the cross member relative to the shackle to keep the cross member and the shackle in a position of relative angular orientation.

14 Claims, 4 Drawing Sheets

U.S. PATENT DOCUMENTS

| | | | |
|---|---|---|---|
| 4,426,861 | 1/1984 | Chillis | 70/39 |
| 4,524,591 | 6/1985 | Lanka | 70/236 |
| 4,545,224 | 10/1985 | Zane | 70/39 |
| 4,584,855 | 4/1986 | Burlingame | 70/38 A |
| 4,674,306 | 6/1987 | Halpern | 70/233 |
| 4,730,470 | 3/1988 | Zane et al. | 70/238 |
| 4,823,566 | 4/1989 | Patton | 70/38 |
| 4,823,567 | 4/1989 | Patton | 70/38 A |
| 4,870,843 | 10/1989 | Lundberg | 70/233 |
| 4,881,387 | 11/1989 | Kortenbrede | 70/39 |
| 4,888,967 | 12/1989 | Kuo | 70/52 |
| 4,918,949 | 4/1990 | Newbold | 70/38 A |
| 4,986,095 | 1/1991 | Chou et al. | 70/46 X |
| 4,987,753 | 1/1991 | Kuo | 70/39 |
| 5,010,746 | 4/1991 | Zane | 70/233 X |
| 5,092,142 | 3/1992 | Zane et al. | 70/39 |
| 5,195,340 | 3/1993 | Huang | 70/38 A |
| 5,199,282 | 4/1993 | Wang | 70/38 A |
| 5,253,496 | 10/1993 | Wang | 70/38 R |
| 5,331,830 | 7/1994 | Su | 70/38 A |
| 5,359,867 | 11/1994 | Ling et al. | 70/28 |
| 5,433,092 | 7/1995 | Kuo | 70/46 |
| 5,490,402 | 2/1996 | Shien | 70/43 X |

HINGED LOCK WITH DETENT POSITIONS

BACKGROUND OF THE INVENTION

This invention relates to locks, and more particularly to locks for a bicycle.

Popular bicycle locks conventionally employ two separate pieces—a cross member and a U-shaped shackle member. Typically, the cross member engages respective end portions of the shackle member an a locking mechanism is activated, using a key, to lock the cross member to the shackle member. The use of two separate components, in this case the cross member and the shackle member requires the use of two hands to perform the operation of locking up a bicycle. In addition, a certain degree of dexterity is required so the user must have both hands free in order to manipulate the components into the required positions for locking.

Various manufacturers have attempted to solve this problem and some have employed a hinge connecting the cross member and shackle member together. The hinges tend to be simple in design, allowing the cross member to swing freely relative to the shackle. To use this type of lock, the user frequently is still required to use two hands to manipulate the lock into the closed position and dexterity is required to support the lock while swinging the cross member closed on the shackle member. The simple hinge solution has therefor been an unsatisfactory solution to the problems with popular locks.

The invention claimed herein provides a cross member hingedly connected to the shackle and includes a lock position holder for holding the cross member and shackle in a given position and for resisting movement of the cross member relative to the shackle. This is an advantage because the user can position the cross member in an open position in which the cross member is held by the lock position holder in a position in which the entire lock can be relatively easily manipulated. Then, with a simple overcoming force, the cross member is snapped into the closed position by the lock position holder. The user therefore merely requires the dexterity to move the lock apparatus into position on the bicycle and to provide a brief overcoming force to cause the lock to be closed. An easily accessible push button actuated locking mechanism is also provided for easy actuation by the user to further simplify the use of the lock with one hand.

Another problem with conventional bicycle locks relates to their susceptibility to breakage due to vandalism. Vandals have been known to place a piece of pipe over a cross member of a lock and use the mechanical leverage so attained to bend or breaks the cross member. Various attempts have been made to circumvent this problem, including minimizing end portions of the cross member which project outwardly past the shackle leg portions and placement of a piece of angle iron adjacent the lock mechanism. The present invention however, employs a fin-shaped projection adjacent the lockset and on an extending part of the cross member such that a vandal cannot get a good grip on the cross member with a pipe and therefore cannot obtain the leverage necessary to bend or break the lock.

SUMMARY OF THE INVENTION

In accordance with one aspect of the invention, there is provided a lock apparatus including a shackle having first and second joined leg portions and a cross member pivotally connected to the first leg portion for pivotal rotation relative to the shackle, about a pivotal axis. The cross member has an opening for receiving a portion of the second leg portion therein when the lock is in a closed position and a bolt connected to the cross member is operable to selectively releasably engage the second leg portion when the lock is in the closed position. The apparatus further includes a lock position holder including a contact member on the cross member and a detent member on the shackle. The contact member and detent member are engageable with each other such that relative movement between the contact member and the detent member is resisted, to interfere with movement of the cross member relative to the shackle to keep the cross member and the shackle in a position of relative angular orientation.

In one embodiment, the detent member has first and second surface portions disposed at different distances from the pivot axis, the first and second surface portions being positionable adjacent the contact member by rotation of the cross member relative to the shackle. When the first surface portion is positioned adjacent the contact member a first detent position is defined and when the second surface portion is positioned adjacent and in contact with the contact member resistance to relative movement is provided.

Preferably, the contact member is resiliently deflected by the second surface portion such that the contact member presents a counter torque to the second surface portion tending to rotate the shackle back into the first detent position.

The first surface portion may be flat and the second surface portion may be curved about an axis parallel to the pivotal axis.

Preferably, the contact member includes a spring member secured to the cross member and the spring member may include a leaf spring which is placed under tension when the second surface portion is in contact therewith.

The detent member may have a third surface portion, disposed at right angles to the first surface portion such that the second surface portion lies between the first and third surface portions, the third surface portion being operable to cooperate with the contact member to define a second detent position in which the cross member is held relative to the shackle.

Preferably, the cross member includes a wall portion defining an opening in the cross member and a pivot pin adjacent the opening, for pivotally connecting the first leg portion to the cross member. The pivot pin and the wall opening therefore define a hinge receptacle having a receptacle opening through which a portion of the first leg portion is received when in the closed position. Preferably, the first leg portion has a butt portion dimensioned to permit movement thereof in the hinge receptacle but too large to permit withdrawal through the receptacle opening.

Preferably, the bolt is included in a locking mechanism connected to a second end portion of the cross member. Preferably, the locking mechanism is operable to extend and retract the bolt generally parallel to the longitudinal axis of the cross member to selectively engage and disengage the second leg portion and preferably, the locking mechanism includes an actuator for controlling the engagement of the bolt with the second leg portion, the actuator being accessible at the second end portion, for operation by a user of the lock. Preferably, the actuator is actuable to engage the bolt without the use of a key.

Preferably, the apparatus includes a projection disposed adjacent the opening for receiving the second leg portion, the projection having a component extending radially outwardly from the cross member and having a sloping surface sloping outwardly relative to the cross member.

In accordance with another aspect of the invention, there is provided a method of holding a shackle of a lock in a desired position relative to a cross member pivotally connected thereto, the method comprising the step of engaging a contact member on the cross member with a detent member on the shackle such that relative movement between the contact member and the detent member is resisted, thereby interfering with rotational movement of the cross member relative to the shackle and tending to keep the cross member and the shackle in a position of relative angular orientation corresponding to the detent position.

Preferably, the method includes step of presenting a counter torque to the detent member, the counter torque tending to rotate the shackle toward the detent position when the shackle is displaced therefrom.

Preferably, the contact member is urged against the detent member such that the contact member is resiliently deflected, by the detent member when the shackle is rotated out of the detent position.

BRIEF DESCRIPTION OF THE DRAWINGS

In drawings which illustrate embodiments of the invention.

DETAILED DESCRIPTION

FIG. 1

Figure 1:
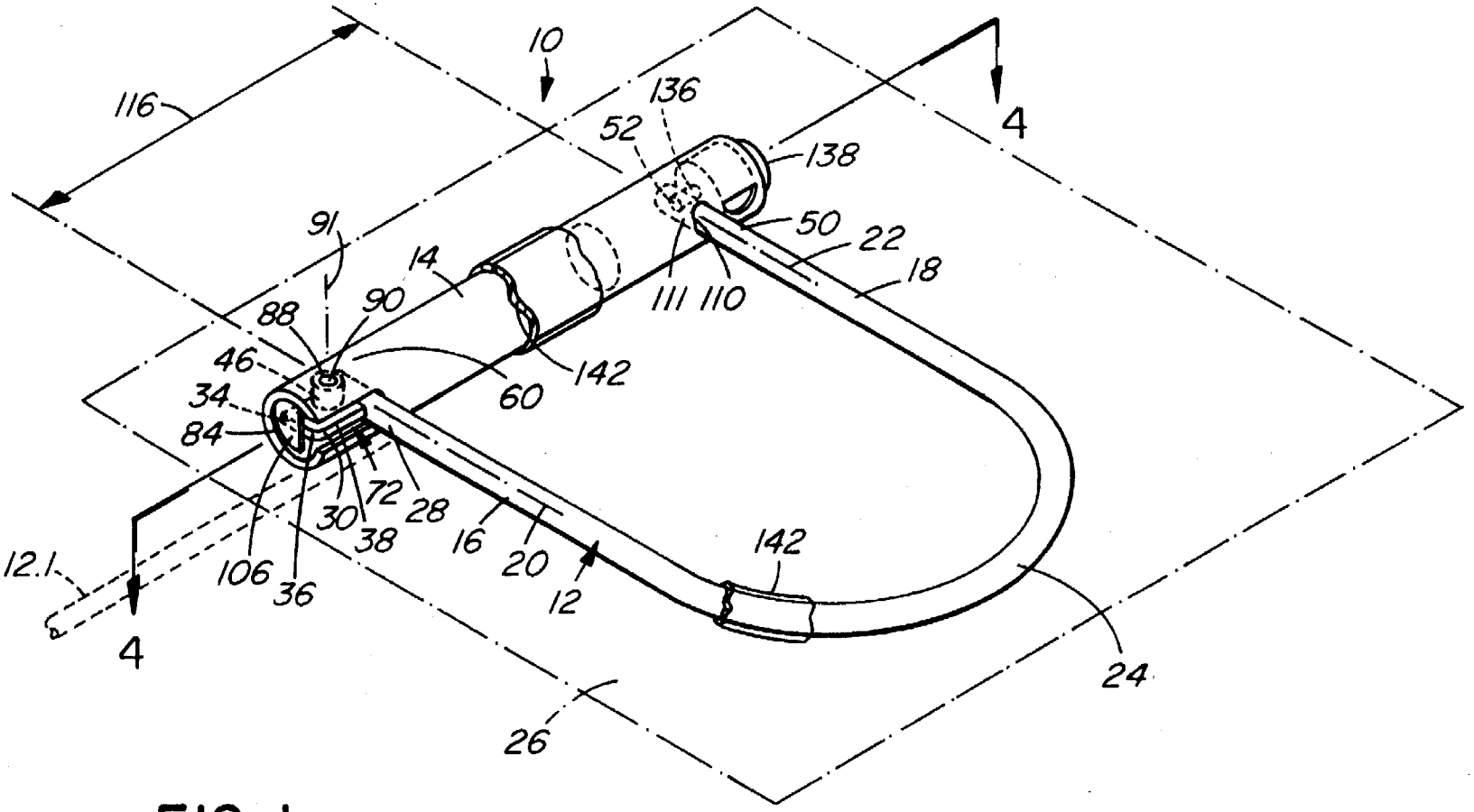
FIG. 1 is a perspective view of a lock according to a first embodiment of the invention.

Referring to FIG. 1, a lock apparatus according to a first embodiment of the invention is shown generally at 10. The apparatus includes a shackle 12 and a cross member 14.

The shackle 12 is formed from an approximately two-foot length of ½-inch diameter hardened steel formed into a U-shape, having first and second spaced apart straight leg portions 16 and 18 having respective axes 20 and 22. The first and second straight leg portions are joined together by a semi-circularly curved intermediate portion 24. The first and second leg portions and the intermediate portion lie in a common shackle plane 26.

The first leg portion 16 has a first distal end portion 28. A detent member 30 is welded to the first distal end portion such that it is generally coplanar with the shackle plane 26 and extends outwardly of the shackle 12.

FIG. 2

Figure 2:
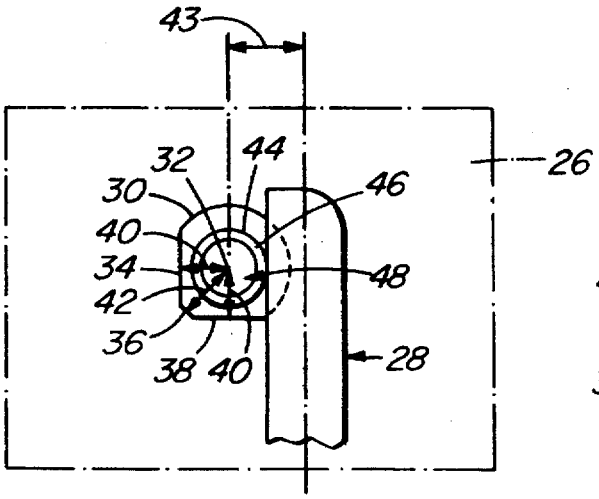
FIG. 2 is a plan view of a first distal end portion of a shackle member of the lock shown in FIG. 1.

Referring to FIG. 2, the detent member 30 is partially circular in shape about a pivotal axis 32 passing perpendicularly therethrough and has first, second and third surface portions 34, 36 and 38 on an outer perimeter thereof. The first and third surface portions 34 and 38 are disposed at right angles to each other and form chords along the outer perimeter of the detent member 30. The second surface portion 36 is disposed between the first and third surface portions 34 and 38 and is curved to join the first and third surface portions together. Generally, the first and third surface portions 34 and 38 are disposed at a first distance 40 from the axis 32, measured from the midpoint of the respective surface to the axis, whereas the second surface portion 36 is disposed at a second distance 42 from the axis, the second distance 42 being greater than the first distance 40.

FIG. 3

Figure 3:
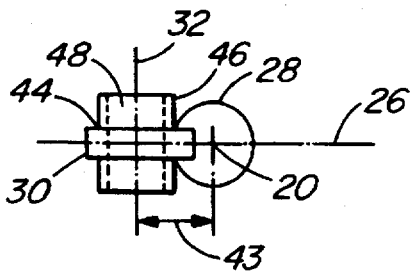
FIG. 3 is an end view of the first distal end portion shown in FIG. 2.

Referring to FIGS. 2 and 3, the detent member 30 is approximately ⅜-inches in thickness and has a circular opening 44 extending about the axis 32 and has a cylindrical bushing 46 having an opening 48 welded in the circular opening 44. The cylindrical bushing thus extends perpendicular to the shackle plane 26. The pivotal axis 32 of the openings 44, 48 is spaced from the axis 20 of the first leg portion by an axis spacing 43 which is sufficiently large such that any clearance required for the bushing in the first distal leg portion 28 of the shackle does not materially weaken the portion 28.

FIG. 4

Figure 4:
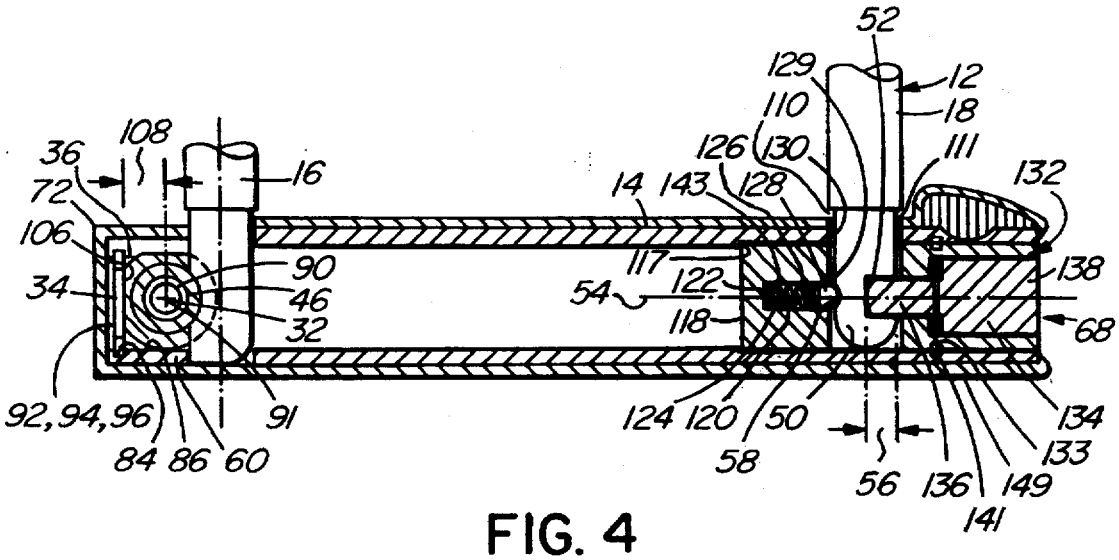
FIG. 4 is a cross-sectional view of the lock shown in FIG. 1 taken along lines 4—4 in FIG. 1.

Referring to FIG. 4, the second leg portion 18 has a second distal end portion 50 having a circular bore 52 approximately ¼-inch in diameter extending radially into the second distal end portion, along an axis 54 coincident with the shackle plane (not shown). The bore 52 extends a distance 56 of approximately one radius (in this embodiment ¼ inches) into the second distal end portion 50.

Diametrically opposite the bore, a concave depression 58 is formed radially inwardly in the second distal end portion 50.

FIG. 5

Figure 5:
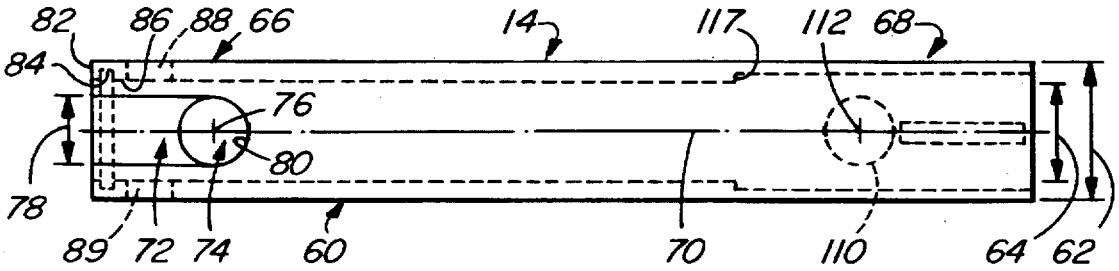
FIG. 5 is a side view of a cross member of the lock shown in FIG. 1.

Referring to FIG. 5, the cross member is shown generally at 14. The cross member is formed from an approximately 7-inch length of hardened steel tubing having a smooth circular cylindrical wall 60 with an outside diameter 62 of approximately 1-inch and an inside diameter 64 of approximately ¾ inches.

Figure 6:
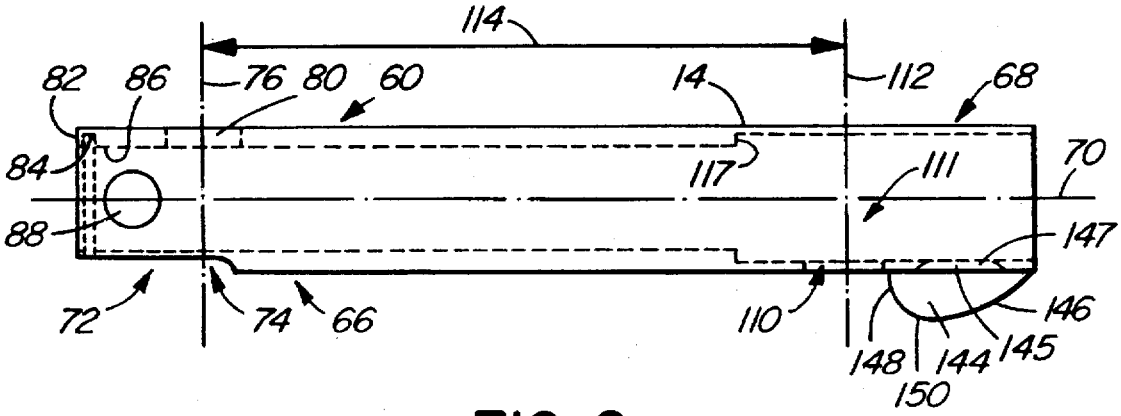
FIG. 6 is a top view of the cross member shown in FIG. 5.

FIGS. 5 and 6

The cross member 14 has first and second end portions 66 and 68 and a longitudinal axis 70. The first end portion 66 has a U-shaped notch 72 cut longitudinally therein, the notch extending approximately 1-inch into the wall 60 of the tubing. The U-shaped notch 72 has a curved, semicircular terminal portion 74 having an axis 76. The notch has a transverse dimension 78 of approximately ½ inches which permits the first leg portion of the shackle (not shown) to be received therein. Referring to FIG. 6, a circular opening 80 is formed in a wall portion diametrically opposite and coaxial with the axis of the terminal portion 74.

The first end portion 66 has an end extremity surface 82 and has an annular groove 84 formed in an inside surface 86 of the wall 60, approximately 1/16 inches from the end extremity surface 82. The groove 84 itself also measures approximately 1/16 inches in width. The groove 84 extends around the entire inside surface 86 of the wall 60 and is broken only by the U-shaped notch 72 described above.

During the forming of the lock, first and second ½ inch diameter, diametrically opposite circular openings 88 and 89 are formed transversely and coaxially in the first end portion 66. Referring back to FIG. 1, the shackle 12 is secured to the cross member 14, by inserting the first distal end portion 28 of the first leg portion 16 into the U-shaped notch 72 and orienting the first leg portion 16 such that the bushing 46 is axially aligned with the first and second diametrically opposite openings, only one of which is shown at 88 in FIG. 1.

A pivot pin 90 matched in diameter to the opening 48 in the bushing 46 is then inserted into one of the diametrically opposite openings (88) such that it extends through the bushing 46 and out the opposite opening. The pivot pin is then crimped in place by flaring opposite ends of the pin and welding or soldering to bind them with the wall 60 of the tubing adjacent and surrounding the first and second opposite openings. The pivot pin 90 is thus secured relative to the cross member 14 and the shackle 12 is thereby secured to the cross member 14. The outer surface of the wall of the tubing about the first and second opposite openings 88 and 89 is then ground and finished to return the outer wall surface to a smooth circular cylindrical shape. The cross member 14 is thus pivotally connected to the first leg portion 16 for pivotal rotation relative to the shackle 12, about a pivotal axis 91.

Referring back to FIG. 4, with the shackle 12 secured to the cross member 14, first, second and third leaf spring members 92, 94 and 96 are stacked on top of each other and are placed in the groove 84 on the inside surface 86 of the tubing wall 60.

Figure 7:
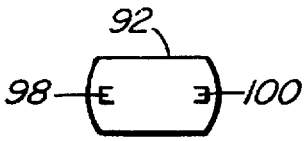
FIG. 7 is a plan view of a spring member of the lock shown in FIG. 1.
Figure 8:
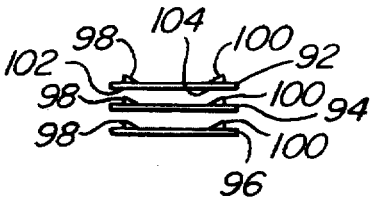
FIG. 8 is a side view of a plurality of spring members forming a contact member of the lock shown in FIG. 1.

FIGS. 7 and 8

Referring to FIGS. 7 and 8, each leaf spring member 92, 94 and 96 is generally planar and rectangular in shape and has first and second tabs 98 and 100 bent out of the plane of the member such that tab receptacles 102 and 104 are formed in the opposite side of the member immediately adjacent the tabs 98 and 100. This allows the tabs 98 and 100 of a spring member immediately adjacent a given spring member to be received in the tab receptacles 102 and 104 of the adjacent spring member and thereby prevents all of the spring members from moving relative to each other when the spring members are stacked as shown exploded in FIG. 8. With the spring members stacked with tabs received in respective receptacles, they form a contact member 106 seen in FIGS. 1, 4, 9, 10 and 11. Referring to FIG. 1, the contact member 106 is inserted into the U-shaped notch 72 and rotated such that opposite edge portions of the contact member are received in diametrically opposite portions of the annular groove 84. Referring to FIG. 4 the spring members 92, 94 and 96 and resulting contact member 106 are dimensioned such that the contact member 106 fits snugly in the groove 84. As the groove 84 is close to the end extremity surface 82, the spring members 92, 94 and 96 of the contact member 106 are located closely adjacent an end portion of the cross member and outwardly of the pivotal pin to permit easy replacement thereof. It is added that should an unauthorized person interfere with the spring members to damage or remove them by using force, this does not effect the security of the lock, but merely the convenience of operation of the lock.

It will be appreciated that the pivot pin 90 has a pivot axis coincident with axis 32 about which the bushing 46 and ultimately, the shackle 12, rotate. It will also be appreciated that the annular groove 84 and the pivot axis 32 are located at a particular distance 108 from each other. This distance 108 is selected such that when the first leg portion 16 of the shackle is positioned to extend at right angles to the longitudinal axis of the cross member as shown in FIG. 4, the first surface portion 34 is disposed to just touch the contact member 106 such that the contact member is slightly bowed outwardly by the first surface portion 34.

FIG. 9

Figure 9:
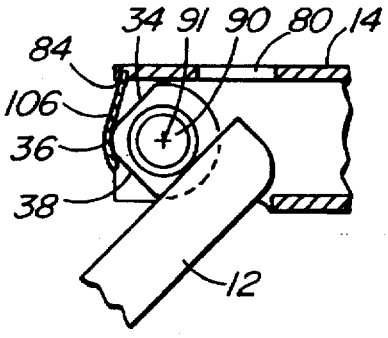
FIG. 9 is a fragmented cross-sectional view of a first end portion of the cross member shown in FIG. 4, showing the shackle rotated relative to the cross member.

Referring to FIG. 9, with the pivot pin 90 positioned at the above indicated distance 108 from the annular groove 84, when the shackle 12 is rotated relative to the cross member 14, the second surface portion 36, which is further from the pivot axis 32 than the first surface portion 34, impinges upon the contact member 106, deflecting it outward and placing a strain on it. The resilience of the spring members cause the contact member 106 to be urged against the second surface portion 36 with greater force than the force by which it was urged against the first surface portion 34 and imposes a net force tending to resist rotational movement of the cross member 14 relative to the shackle 12.

FIG. 10

Figure 10:
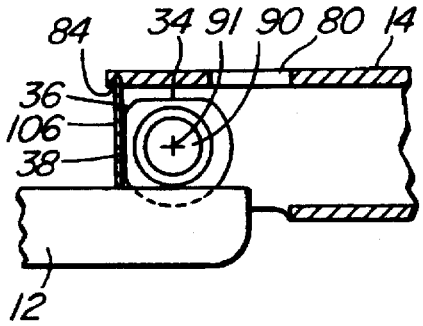
FIG. 10 is a fragmented cross sectional view of the cross member shown in FIG. 4, with the shackle shown rotated to extend parallel to the cross member shown in FIG. 14.

Relative rotation of the cross member 14 and shackle 12 maintains the force on the second surface portion 36 until sufficient rotation has occurred such that the third surface portion 3S is in contact with the contact member as shown in FIG. 10. Since the third surface portion 38 is located closer to the pivot axis 32 than the second surface portion 36, the contact member 106 is deflected less than it was by the second surface portion 36 and the force imposed by the contact member 106 is reduced. However, any tendency to rotate the second surface portion 36 back toward the contact member 106 is resisted by the resilience of the contact member 106 just as it was when the first surface portion 34 was in contact with the contact member 106. Hence, when the first or third surface portions 34 or 38 are in contact with the contact member 106, the contact member 106 is relatively relaxed and presents little or no force opposing relative rotation of the cross member 14 and shackle 12. However, rotation of the shackle 12 relative to the cross member 14 such that the second surface portion 36 bears upon the contact member 106 tends to deflect the contact member 106 such that a strong resistance to further rotation is presented. Hence, any movement of the second surface portion 36 sufficient to deflect the contact member 106 is met with resistance caused by the resilience of the contact member 106. Therefore, the positions wherein the first or third surface portions 34 and 38 are adjacent the contact member 106 define detent positions in which the contact member 106 is relaxed and from which rotation of the shackle relative to the cross member 14 is resisted.

Referring back to FIGS. 5 and 6, the second end portion 68 of the cross member 14 has a single opening 110 disposed in the tubing wall 60, along an axis 112 parallel with the axis 76 of the terminal portion 74 of the U-shaped notch 72. The axis 112 of the single opening 110 is spaced apart from the axis of the terminal portion 74 by a distance 114 equal to the distance (116 in FIG. 1) between respective axes 21 and 22 of the first and second leg portions 16 and 18 of the shackle 12, such that the second distal end portion 50 of the second leg portion 18 can be received in the opening 110 when the cross member 14 is suitably rotated. The opening 110 defines a receptacle 111 in which the second distal end portion 50 of the second leg portion 18 of the shackle 12 is received and held.

The inside surface 86 of the tubular wall 60 at the second end portion 68 is bored to form an inner shoulder portion 117 inwardly of the opening 110. Referring to FIG. 4, the shoulder portion 117 cooperates to hold in place a bored cylinder 118 having a bore 120 in which a first end portion 122 of a spring 124 contacts a bottom portion 143 of the cylinder. A second end portion 126 of the spring contacts a ball bearing 128 inserted into the bore 120 and the bore opening 129 is pressed inwardly to hold the ball bearing 128 and spring inside the bore 120. The spring length and spring force constant are chosen such that the ball bearing 128 is urged outwardly, against the pressed bore opening 129 such that a potion of the ball bearing projects out the opening 129. An industrial strength metal bonding adhesive is used in conjunction with the bore to hold the cylinder in place.

The cylinder 118 is dimensioned to extend from the inner shoulder portion 117 to an innermost edge 130 of the opening 110 such that when viewed through the opening 110, a portion of the ball bearing is seen to project radially inwardly toward the centre of the receptacle 111. The ball bearing 128 is operable to ride on the second distal end portion 50 as it is inserted into or retracted from the opening 110. As the second distal end portion 50 is inserted into the opening, the ball bearing 128 is forced into the bore 120, compressing the spring 124 until the concave depression 58 in the second distal end portion 50 is adjacent the bore opening 129 whereupon the spring 124 forces a portion of the ball bearing 128 into the concave depression 58, thereby lightly holding the second distal end portion 50 in the receptacle 111.

A key lock mechanism 132 is further secured to the second end portion 68 of the cross member 14 to secure the second distal end portion 50 in the receptacle 111. In the preferred embodiment, the lock mechanism 132 is available from the Yu Chih Company Ltd. of Taipei Taiwan as Model No. LJ801H. Generally, this lock mechanism has a hardened steel cylindrical casing 134 which houses a bolt 136 and a push button actuator 138. The dimensions of the casing 134 permit it to be received and held snugly within the inner diameter of the tube wall 60.

Figure 11:
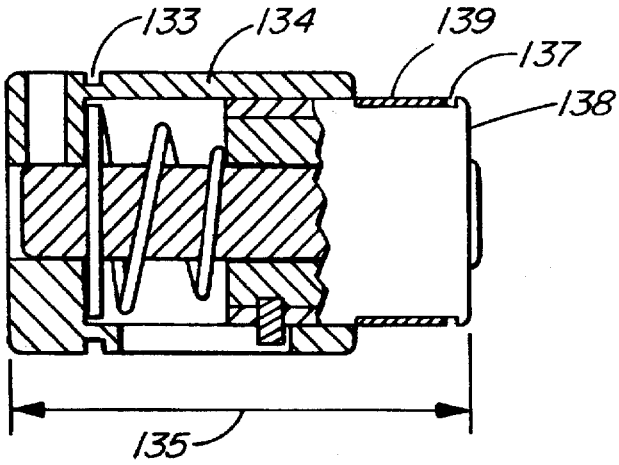
FIG. 11 is a cross sectional view of a lock mechanism according to the first embodiment of the invention.

Referring to FIG. 11, the lock is modified to have a 0.5 mm annular groove 133 cut in the casing 134 and the overall length is custom made to make the overall length 135 about 31.5 mm. In addition, the push button actuator 138 is turned downslightly as shown at 137, to accommodate a heat shrinkable, coloured band 139 which serves as an indicator to readily indicate whether or not the lock is locked or unlocked.

The lock mechanism 132 is positioned in the cross member 14 such that the bolt 136 is operable to extend into and retract from the receptacle 111 along a line generally parallel to the longitudinal axis of the cross member such that it can be received in and retracted from the ¼-inch circular bore 52 in the second distal end portion 50. In addition, the cross member 14 is dimensioned such that an outer edge 140 of the second end portion 68 is generally coplanar with the lock casing 134 such that only the push button actuator 138 is operable to extend beyond the outer edge 140, when the lock is unlocked. Art annular groove 141 is formed in the inside wall of the cross member, at a location which is aligned with the groove 133 on the lock when the lock is in the desired position relative to the cross member. An expandable spring clip 149 is mounted in the groove 139 on the lock before it is installed in the cross member such that the spring clip expands when the grooves 133 and 141 are aligned. Respective portions of the spring clips extend into respective portions of the grooves to secure the lock in the cross member. An industrial metal bonding adhesive is used in conjunction with the spring clip to hold the lock in place.

Referring to FIGS. 5 and 6 the second end portion 68 further has an approximately ½ inch long slot 145 into which a cooperating portion 147 of a projection 144 welded to the outside wall 60 of the tubing, adjacent the opening 110. Preferably the projection 144 is approximately 3/16 inches thick, is fin shaped to have a portion which extends radially outwardly from the cross member 14 and lies in the shackle plane. The fin shape has a downward, gently sloping surface portion 146 sloping outwardly downward toward the outer edge 140 of the cross member 14, and has a greatly sloping portion 148 sloping downward toward the single opening 110. Also preferably, the gently sloping portion 146 and the greatly sloping portion 148 are connected together by a smoothly curved portion 150. The purpose of the projection 144 is to defeat the leverage which would otherwise by applied to the second end portion by a vandal placing a pipe over the second end portion 68 and attempting to break or bend the lock mechanism or cross member. The projection prevents such a vandal from getting a good grip on the second end portion 68 with a pipe, as the projection significantly reduces the contact area of the pipe. Only a pipe of much greater diameter than the cross member 14 will fit over the second end portion 68 with the projection 144 thereon and a relatively loose fit is all that can be obtained.

Referring back to FIG. 1, it will be appreciated that each component of the lock including the cross member 14 and the shackle 12 can be covered with a plastic protective skin material 142 such as that described in U.S. Pat. No. 5,092,142 to Zane, et al., provided the opening 110 and the U-shaped notch 72 remain uncovered. Alternatively, a rigid plastic jacket can be formed over the shackle and cross member.

Operation

Referring to FIG. 1, with the lock assembled as described above, it is assumed the lock is closed wherein the second distal end portion 68 is received in the opening 111 in the cross member and the first surface portion 34 is adjacent the contact member 106. The detent member is thus in a first detent position. The lock is readied for use by first unlocking the lock mechanism using a key (not shown). This is done by rotation of a key in the lock mechanism, which retracts the bolt from the ¼ inch bore 52 in the second distal end portion 50.

With the bolt 136 retracted, the user may apply a brief burst of opposing force between the second distal end portion 50 and the cross member 14 to overcome the holding force imposed by the ball bearing (126 in FIG. 4) in the concave depression (58 in FIG. 4).

By the time the holding force of the ball bearing 128 has been overcome, the shackle 12 will have been rotated sufficiently to engage the second surface portion 36 of the detent member 30 with the contact member whereby the contact member 106 is resiliently deflected, placing the spring members 92 under tension and presenting a counter-torque to the second surface portion 36 tending to resist relative movement between the contact member and the detent member, thereby interfering with movement of the cross member 14 relative to the shackle 12. The user however, can maintain a rotational force between the cross member 14 and the shackle 12 to continue rotation until the first leg portion 16 is nearly parallel (as seen in broken outline) with the cross member 14 at which time the third surface portion 38 comes into contact with the contact member 106 and the contact member 106 becomes relaxed. As the third surface portion 38 comes into contact with the contact member, the resilience of the contact member 106 applies an assisting torque complementing the rotation of the shackle whereby the first leg portion 16 "snaps" into a position parallel with the cross member 14 as shown partially in broken outline. The detent member is thus in a second detent position and the lock is thus in an open or ready position.

It will be appreciated that the lock is held in the open or ready position by the resilience of the contact member 106 which tends to resist deflection when the second surface portion 36 comes into contact with the contact member 106 such as by any relative rotation tending to close the lock. Hence the resilience of the contact member 106 tends to maintain the second surface portion 36 out of contact therewith, favouring contact with the third surface portion 38 wherein the contact member 106 is relaxed when the lock is in the open position. The contact member 106 thus tends to keep the cross member 14 and the shackle 12 in a position of relative angular orientation, in the present case parallel to each other.

With the lock in the open position, the second leg portion 18 can be looped around an object to be locked, such as a bicycle (not shown). Because the lock is held in the open position by the contact member 106 acting upon the third surface portion 38, the lock can be manipulated around the object to be locked, with one hand.

When the lockable object is ready to be locked, the user merely rotates the cross member 14 relative to the shackle 12 with sufficient force to overcome the resistance imposed by the second surface portion 36 riding on the contact member 106 to move the cross member 14 from the open position, until the second distal end portion 50 of the second leg portion 18 is about to be received in the receptacle 111. As the cross member 14 is rotated into the closed position, just before the second distal end portion 50 is fully received in the receptacle 111, the first surface portion 34 comes into contact with the contact member 106 which permits the contact member 106 to relax. The second distal end portion 50 thereby "snaps" into the receptacle 111 whereupon the ball bearing (126 in FIG. 4) engages the concave depression (58 in FIG. 4) and holds the lock closed. In addition, the contact member 106 tends to keep the cross member 14 and the shackle 12 in a new position of relative angular orientation, in the present case, perpendicular to each other.

It will be appreciated that the above act of closing the cross member 14 on the second distal end portion 50 can be done with one hand simply by engaging the shackle 12 against the object to be locked and using the object as a stop to prevent rotation of the shackle 12 as rotational force is applied to the cross member 14.

With the second distal end portion 50 lightly held in the receptacle 111, the bolt 136 may be engaged with the ¼ inch bore 52 in the second distal end portion 50 by simply depressing the push button actuator 138, which is accessible from the second end portion 68 of the cross member. It will be appreciated that the push button actuator 138 can be operated by the thumb or finger of the user and that the same hand which is used to rotate the cross member 14 can be place the lock the actuator to place the lock in the locked condition. Hence it will be appreciated that the detent positions provided by the detent member 30 and the positioning of the lock mechanism such that the actuator extends out of the second end portion 68 of the cross member 14, facilitates operation with one hand.

Alternatives

FIG. 12

Figure 12:
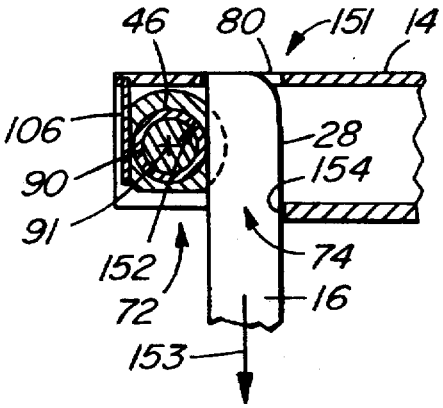
FIG. 12 is a fragmented cross sectional view of a portion of a cross member and first distal end portion of a lock according to a second embodiment of the invention.

Referring to FIG. 12 a second embodiment of the invention is shown generally at 151. In this embodiment all components are identical to those of the first embodiment with the exception of the first distal end portion 28 of the first leg portion of the shackle. This component differs in that it has a slight outwardly curved portion 152 which partially wraps around the bushing 46. This adds extra protection from vandals which may attempt to separate the first leg portion 16 from the cross member 14.

The extra protection is afforded because the effective opening defined by the terminal portion 74 of the U-shaped notch 72, through which the first distal end portion 28 can extend is bounded by the tubing wall at 154 and by the bushing 46 mounted on the pivot pin 90. By providing the curved portion 152 and causing it to extend partially around the bushing 46, the curved portion 152 is larger than the effective opening and cannot be drawn through the effective opening if pulled perpendicularly outward in the direction of arrow 153 from the cross member 14. Thus, even if the weld holding the detent member and bushing 46 to the first distal end portion 28 were to fail, the first distal end portion could not be pulled radially outwardly from the cross member 14 as the curved portion 152 would interfere with the pivot pin 90.

While specific embodiments of the invention have been described and illustrated, such embodiments should be considered illustrative of the invention only and not as limiting the invention as construed in accordance with the accompanying claims.

What is claimed is:

1. A lock apparatus comprising:

a) a shackle having first and second joined leg portions;

b) a cross member pivotally connected to said first leg portion for pivotal rotation relative to said shackle about a pivotal axis, said cross member having an opening for receiving a portion of said second leg portion therein when said lock is in a closed position;

c) a bolt operable to selectively releasably engage said second leg portion when said lock is in said closed position; and d) a lock position holder including a resilient contact member cooperating with the cross member and a detent member on the shackle, wherein said detent member has first, second and third surface portions, the second surface portion being disposed between the first and third surface portions and at a greater distance from the pivotal axis than the first and third surface portions, the contact member and detent member being rotatable relative to each other and engageable with each other such that said first and third surface portions are selectively positionable adjacent said contact member to define first and third detent positions in which said contact member is relatively relaxed, and said second surface portion is selectively positionable in contact with said contact member to define a second detent position in which the contact member is relatively strained, thus tending to cause the detent member of the shackle and the contact member of the cross member to resist movement from either the first or the third detent positions which reflect closed and open positions of lock apparatus respectively.

2. An apparatus as claimed in claim 1 wherein said first surface portion is flat and wherein said second surface portion is curved about an axis parallel to said pivotal axis.

3. An apparatus as claimed in claim 1 wherein said contact member includes a spring member secured to the cross member.

4. An apparatus as claimed in claim 3 wherein said spring member includes a leaf spring which is placed under tension when said second surface portion is in contact therewith.

5. An apparatus as claimed in claim 1 wherein:

a) the cross member has a wall portion defining an opening in said cross member;

b) the detent member extends laterally from the first leg portion and has a pivot opening therein concentric with the pivotal arms, and c) a pivot pin is provided adjacent the opening in the wall portion and passes through the pivot opening in the detent member for pivotally connecting the first leg portion to said cross member, said pivot pin and said wall opening defining a hinge receptacle having a receptacle opening through which a portion of said first leg portion is received when in the closed position.

6. An apparatus as claimed in claim 5 wherein said first leg portion has a butt portion dimensioned to permit movement thereof in said hinge receptacle but too large to permit withdrawal through said receptacle opening.

7. An apparatus as claimed in claim 1 further including a locking mechanism connected to said cross member, said bolt being included in said locking mechanism, said locking mechanism being operable to extend and retract said bolt to selectively engage and disengage said second leg portion.

8. An apparatus as claimed in claim 7 wherein said cross member has first and second opposite end portions, said first leg of said shackle being pivotally connected to said first end portion and said locking mechanism being connected to said second end portion.

9. An apparatus as claimed in claim 8 wherein said locking mechanism is disposed at said second end portion such that said bolt is operable to extend generally parallel to a longitudinal axis of said cross member to engage said second leg portion.

10. An apparatus as claimed in claim 9 wherein said locking mechanism includes an actuator for controlling the engagement of the bolt with the second leg portion, said actuator being accessible at said second end portion, for operation by a user of the lock.

11. An apparatus as claimed in claim 10 wherein said actuator is actuable to engage said bolt without the use of a key.

12. An apparatus as claimed in claim 1 further including a projection disposed adjacent the opening for receiving said second leg portion, said projection having a fin-shaped component extending radially outwardly from said cross member.

13. An apparatus as claimed in claim 12 wherein said projection has a sloping surface, said sloping surface sloping outwardly relative to said cross member.

14. An apparatus as claimed in claim 1, in which:

(a) the shackle swings through approximately 90 degrees between open and closed positions thereof, and (b) the first and third surface portions of the detent member are disposed at approximately 90 degrees to each other and at equal distances from the pivotal axis.

* * * * *